US008692721B2

(12) United States Patent
Hsieh et al.

(10) Patent No.: US 8,692,721 B2
(45) Date of Patent: Apr. 8, 2014

(54) WIRELESS COMMUNICATING DEVICE AND PORTABLE ELECTRONIC APPARATUS USING THE SAME

(75) Inventors: Tsung-Ying Hsieh, Hsinchu (TW); Lee-Cheng Shen, Hsinchu (TW); Chin-Lien Hsu, Hsinchu (TW)

(73) Assignee: Quanta Computer Inc., Tao Yuan Shien (TW)

( * ) Notice: Subject to any disclaimer, the term of this patent is extended or adjusted under 35 U.S.C. 154(b) by 837 days.

(21) Appl. No.: 12/714,637

(22) Filed: Mar. 1, 2010

(65) Prior Publication Data

US 2010/0289706 A1 Nov. 18, 2010

(30) Foreign Application Priority Data

May 18, 2009 (TW) ..... 98116387 A

(51) Int. Cl.
*H01Q 1/24* (2006.01)

(52) U.S. Cl.
USPC ..... 343/702; 343/873

(58) Field of Classification Search
None
See application file for complete search history.

(56) References Cited

U.S. PATENT DOCUMENTS

| | | | | |
|---|---|---|---|---|
| 6,867,746 | B2 | 3/2005 | Mendolia et al. | |
| 7,321,334 | B2 | 1/2008 | Yu | |
| 2003/0080906 | A1 * | 5/2003 | Miyasaka | 343/702 |
| 2007/0241971 | A1 | 10/2007 | Tsujimura et al. | |
| 2009/0051606 | A1 * | 2/2009 | Ochi et al. | 343/702 |
| 2009/0058737 | A1 * | 3/2009 | Tsujimura et al. | 343/702 |
| 2009/0284424 | A1 * | 11/2009 | Yoon et al. | 343/702 |

FOREIGN PATENT DOCUMENTS

| | | |
|---|---|---|
| TW | 200805783 | 1/2008 |

* cited by examiner

*Primary Examiner* — Trinh Dinh
(74) *Attorney, Agent, or Firm* — Rabin & Berdo, P.C.

(57) ABSTRACT

A portable electronic apparatus is provided which includes a first housing, a second housing, a control unit, a display unit, and a wireless communication device. The two housings are rotatably coupled to each other. The control unit is accommodated in the first housing. The display unit is accommodated in the second housing and is connected to the control unit. The wireless communication device is accommodated in the second housing and has a wireless communication module and an antenna. The wireless communication module is connected to the control unit and the antenna, and is configured to perform wireless communication through the antenna under control of the control unit.

10 Claims, 8 Drawing Sheets

WIRELESS COMMUNICATING DEVICE AND PORTABLE ELECTRONIC APPARATUS USING THE SAME

This application claims the benefit of Taiwan application Serial No. 98116387, filed May 18, 2009, the subject matter of which is incorporated herein by reference.

BACKGROUND OF THE APPLICATION

1. Field of the Application

The application relates in general to a wireless communication device and a portable electronic apparatus using the same, and more particularly to a wireless communication device and a portable electronic apparatus in which an antenna is incorporated into a wireless communication module.

2. Description of the Related Art

Recently, wireless communication devices are usually accommodated in portable electronic apparatuses, such as a notebook book, a personal computer, or a personal digital assistant.

A wireless communication device usually includes a wireless communication module and an antenna. The wireless communication module is electrically connected to a main board, and is used for performing wireless communication through the antenna under control of a controller of the main board. Conventionally, the wireless communication module can be disposed on the main board of the notebook while the antenna can be disposed on a remote place of the main board for earning a better transceiver performance. In order for the controller which is accommodated on the main board to perform communication, it can control the wireless communication module which is also accommodated on the main board to transmit or receive antenna signals.

The antenna signals between wireless communication module and the antenna are usually transmitted through a cable. When being transmitted therethrough, the signals usually decay due to the resistance of cable. For a longer cable, the resistance thereof is increased, and the signal decay is getting serious. In this regard, the signals will decay significantly because of the long distance between a conventional wireless communication module which is disposed on the main board and the antenna which is disposed on a remote place of the main board. Moreover, such a decay of antenna signal may further diminish the sensitivity of the wireless communication module.

SUMMARY OF THE APPLICATION

The application is directed to a wireless communication device and a portable electronic apparatus using the same, an embodiment of which can reduce the decay of antenna signals, enhance the sensitivity of wireless communication module, reduce the power dissipation, and improve the system performance. As in another embodiment, the provided wireless communication device can also be reduced for its occupied space on a main board thus saving the required space.

According to an aspect of the present application, a wireless communication device is provided. The wireless communication device includes a wireless communication module and an antenna. The wireless communication module includes a circuit board, a number of electronic elements, and a cover layer. The electronic elements are disposed on the circuit board for performing wireless communication. The cover layer is disposed on the circuit board for covering and protecting the electronic elements on the circuit board. The cover layer has at least one via hole which exposes a part of the circuit board. The antenna is disposed on the surface of the cover layer of the wireless communication module, and is electrically connected to the circuit board through the at least one via hole.

According to another aspect of the present application, a wireless communication device is provided which includes a wireless communication module and a flexible circuit board. The wireless communication module includes a circuit board, a number of electronic elements, and a cover layer. The electronic elements are disposed on the circuit board for performing wireless communication. The cover layer is disposed on the circuit board for covering and protecting the electronic elements on the circuit board. The interconnection of the flexible circuit board has an antenna. A part of the flexible circuit board is embedded in the circuit board. The flexible circuit board is electrically connected to the circuit board of the wireless communication module at where it is embedded in the circuit board.

According to another aspect of the present application, a portable electronic apparatus is provided which includes a first housing, a second housing, a control unit, a display unit, and a wireless communication device. The two housings are rotatably coupled to each other. The control unit is accommodated in the first housing. The display unit is accommodated in the second housing and is connected to the control unit. The wireless communication device is accommodated in the second housing and has a wireless communication module and an antenna. The wireless communication module is connected to the control unit and the antenna, and is configured to perform wireless communication through the antenna under control of the control unit.

The application will become apparent from the following detailed description of the preferred but non-limiting embodiments. The following description is made with reference to the accompanying drawings.

DETAILED DESCRIPTION OF THE APPLICATION

Provided below are the description for a portable electronic apparatus and a wireless communication device thereof according to embodiments of this application. In an embodiment of this application, the portable electronic apparatus can be, for example but no-limitedly, a notebook. Such a notebook to which the portable electronic apparatus can be applied is taken as an example for illustration.

Figure 1A:
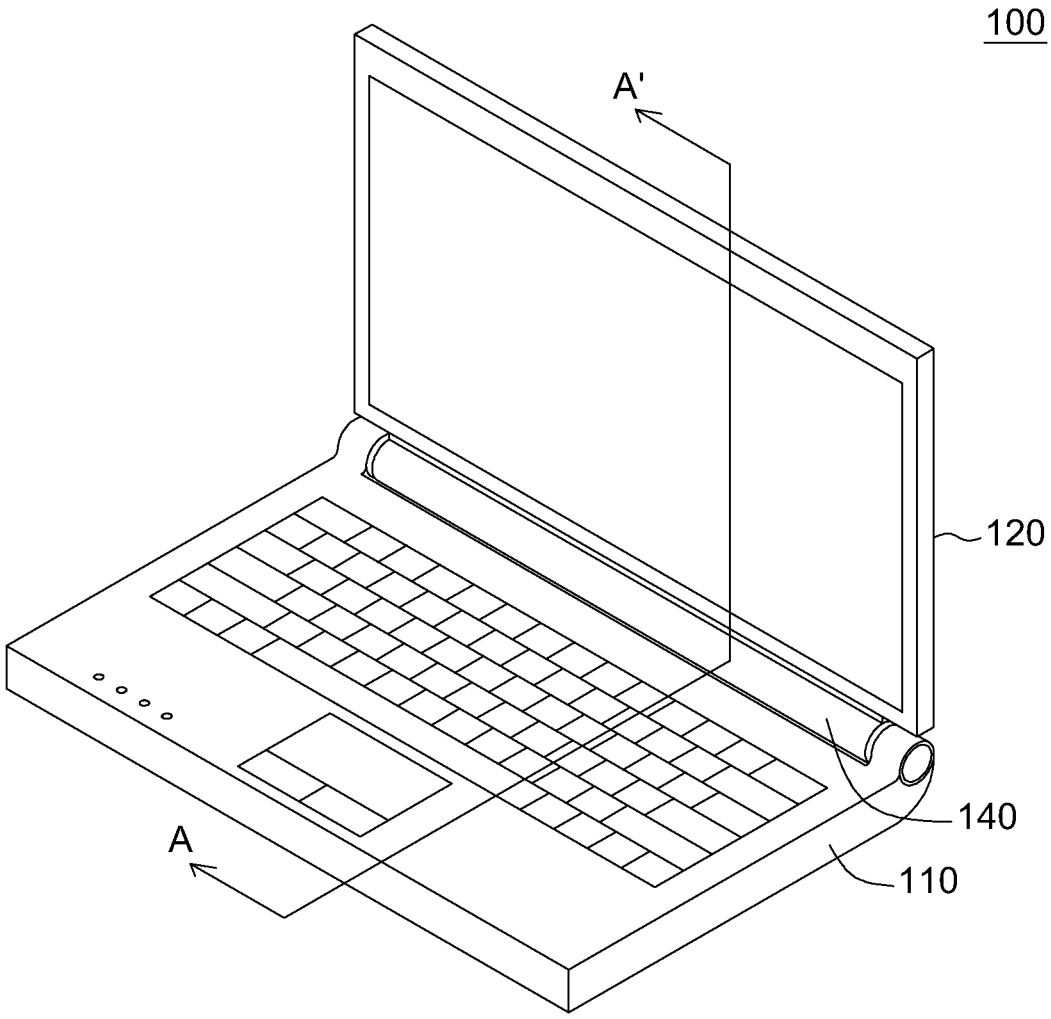
FIG. 1A is a schematic diagram showing an example of the portable electronic apparatus which is applied to the notebook according to an embodiment of the application.
Figure 1B:
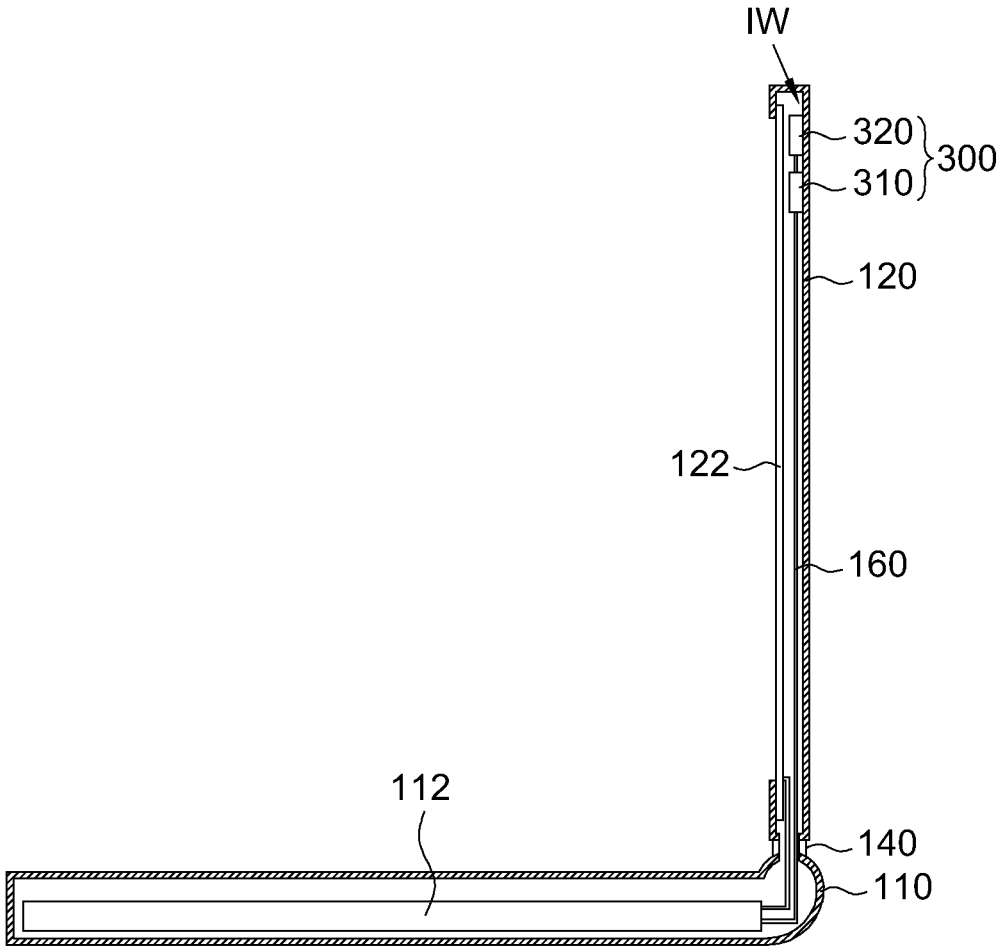
FIG. 1B is a cross-section view according to the line A-A' in FIG. 1A.

Refer to FIGS. 1A and 1B. FIG. 1A is a schematic diagram showing an example of the portable electronic apparatus which is applied to the notebook according to an embodiment of the application. FIG. 1B is a cross-section view according to the line A-A' in FIG. 1A. The portable electronic apparatus 100 includes a first housing 110, a second housing 120, a control unit 112, a display unit 122, and a wireless communication device 300.

The two housings are rotatably coupled to each other. In an embodiment, the portable electronic apparatus can further include a hinge 140, which is rotatably coupled the first housing 110 to the second housing 120. Corresponding to how the hinge 140 is rotated, the two housings 110 and 120 of the portable electronic apparatus 100 are enabled to move between the open position and close position. For example, the two housings 110 and 120 in FIG. 1A are in the open position.

As shown in FIG. 1B, the controller unit 112 is accommodated in the first housing 110, the display unit 122 is accommodated in the second housing 120, and the wireless communication device 300 is also accommodated in the second housing 120. The display unit 122 is connected to the control unit 112.

The wireless communication device 300 has a wireless communication module 310 and an antenna 320. The wireless communication module 310 is connected to the control unit 112 and the antenna 320, and is configured to perform wireless communication through the antenna 320 under control of the control unit 112.

Further description is provided below for the comparing the portable electronic apparatus 100 of the embodiment with a conventional notebook in which a wireless communication module is adjacent to the controller unit 112 and is distant from the antenna, so as to demonstrate the advantages of the embodiment.

First, in conventional, a wireless communication module 310 is accommodated in the first housing 110, and is connected to the control unit 112. However, in the portable electronic apparatus 100 of the embodiment, the wireless communication module 310 can be disposed on a place inside the second housing 120 and adjacent to the antenna 320, thereby reducing the distance between the wireless communication module 310 and the antenna 320. In this way, the decay of antenna signals between the wireless communication module 310 and the antenna 320 can be reduced.

Moreover, since the embodiment is capable of reducing the decay of antenna signals, it can enhance the sensitivity of wireless communication module 310 in a receiver mode, while reduce power dissipation and improve the system performance in a transmitter mode.

Furthermore, in the first housing 110, the control unit 112 usually is disposed on a main board (not shown), on which a conventional wireless communication device 300 is also disposed to be connected with the control unit 112. This way, however, occupies considerate space of the main board. On the other hand, the wireless communication device 300 of the embodiment can be accommodated in the second housing 120, which allows the wireless communication device 300 to be connected to the main board through input/output connectors, thereby reducing the occupied space of wireless communication device 300 in the main board and saving the required space.

Further description is provided below for elaborating the portable electronic device 100. Refer to FIG. 1B, in which the connection between the wireless communication device 300 and the controller unit 112 are wired connection. As shown in FIG. 1B, the portable electronic apparatus 100 can further include, for example, a transmission line 160. The transmission line 160 allows the wireless communication module 310 to be connected to the control unit 112, thus forming signal connection to transmit digital signals between the wireless communication module 310 and the control unit 112. In practical, the transmission line 160 can be, for example but not-limitedly, a transmission line complied with standard protocols of digital input/output interface, such as a transmission line complied with universal serial bus (USB) protocol.

Taking the USB transmission line as an example, the USB transmission line can be used for transmitting digital signal between the wireless communication module 310 and the control unit 112, thereby preventing signal decay which exists in transmitting analogous signal. Moreover, because the USB transmission line can be regarded as a transmission line widely used in the field, the portable electronic apparatus 100 of the embodiment can be used in various electronic devices integrated with USB interfaces, such as a notebook. Therefore, the embodiment can increase the flexibility in designing the portable electronic apparatus 100. Moreover, by using the USB transmission line in the wireless communication device 300, the main board's extended input/output connectors which have limited amounts and are for special purposes can be reserved for being used in the portable electronic apparatus 100 with respect to different requirements, thereby further increasing the flexibility in designing.

The previous description takes the USB transmission line as examples, and this embodiment, however, is not limited thereto. Any transmission interface which is widely used at present or in the future can also be used to establish the connection between the wireless communication device and the control unit, the embodiment of which is also within the scope of the application.

Figure 2A:
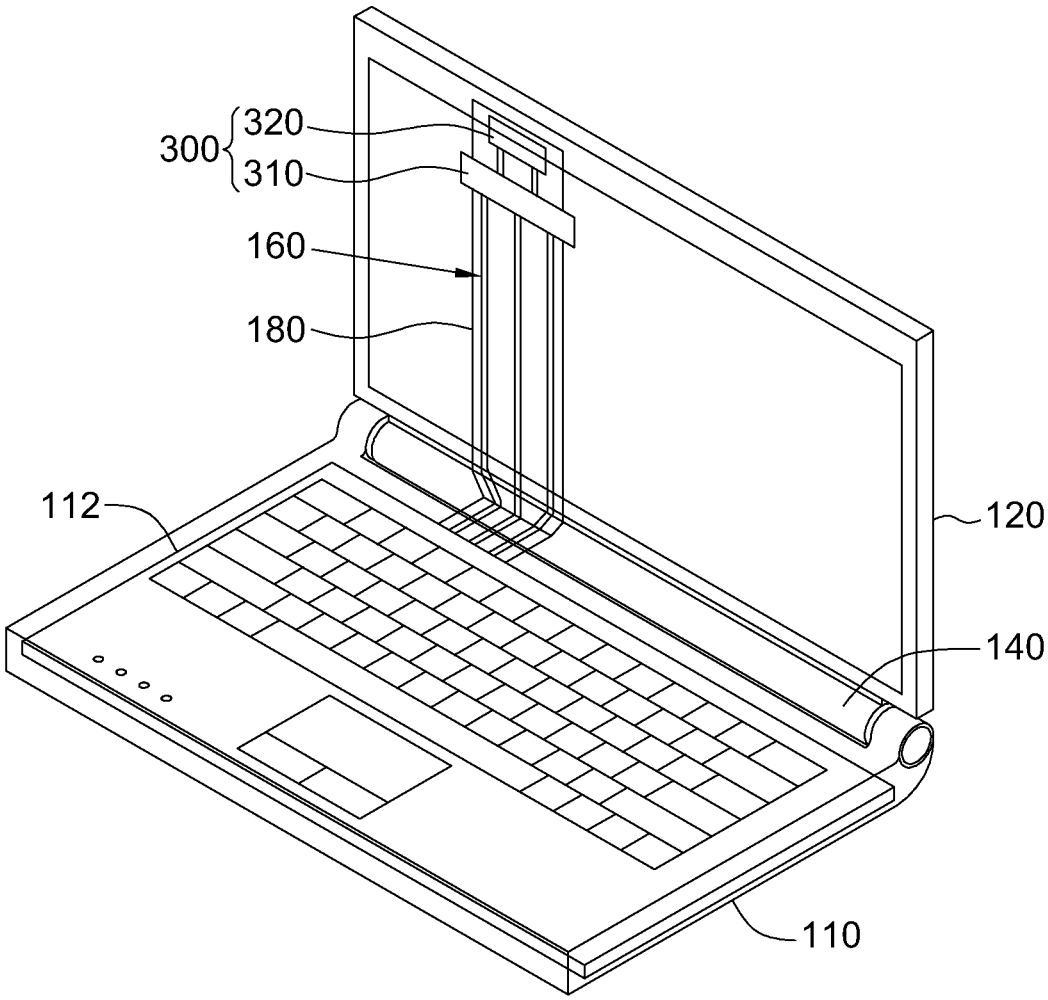
FIGS. 2A to 2D are schematic diagrams each showing an example of the connection between the wireless communication device and the control unit according to an embodiment of the application.

The transmission line 160 of this application can be implemented with different embodiments. As in a practical example, the transmission line 160 can be implemented on a flexible circuit board, which is shown in FIG. 2A. FIG. 2A is a schematic diagram showing an example of the connection between the wireless communication device 300 and the control unit 112 according to an embodiment of the application. In this example, the portable electronic apparatus 100 can further include a flexible circuit board 180. The flexible circuit board 180 passes through the two housings 110 and 120 as well as the hinge 140, and the transmission line 160 is disposed on the flexible circuit board 180. In this way, the transmission line 160 which is disposed on the flexible circuit board 180 can thus connect the wireless communication module 310 to the control unit 112.

Figure 2B:
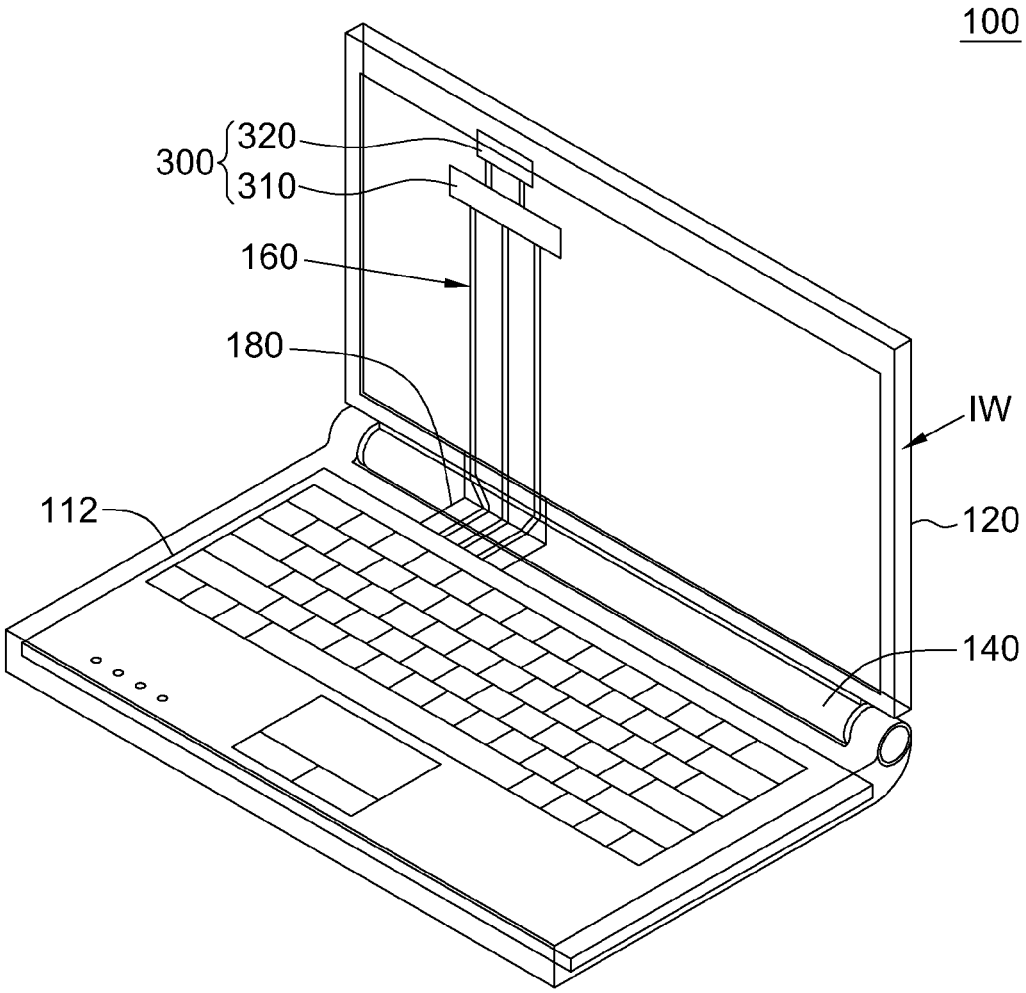

As in another practical example, at least a part of the transmission line 160 can be disposed on the inner wall of the second housing 120, which is shown in FIG. 2B. FIG. 2B is a schematic diagram showing another example of the connection between the wireless communication device 300 and the control unit 112 according to an embodiment of the application. In this example, at least a part of the transmission line 160, such as the transmission line 160 accommodated in the second housing 120, can be implemented by way of metal deposition. The metal deposition is, for example, capable of forming interconnection on plastic materials. In the course of using this way to implement the transmission line 160, the inner wall IW of the second housing 120 is first laser-activated on its surface, and is processed by chemical electroplating and metal deposition for forming interconnection. In this way, the transmission line 160 can be disposed on the inner wall IW of the second housing 120. Therefore, the transmission line 160 which is disposed on the inner wall IW of the second housing 120 can, via the flexible circuit board 180 which passes though the hinge 140, connect the wireless communication module 310 to the control unit 112.

The antenna 320 of this application can also be implemented with different embodiments. As in an embodiment shown in FIG. 2A, the antenna 320 can be disposed on the flexible circuit board 180 by using the layout of antenna to form its structures thereon. As in another embodiment shown in FIG. 2B, similar to the transmission line 160 disposed on the inner wall IW of the second housing 120, the antenna 320 can also be disposed on the inner wall IW of the second housing 120, but this application is not limited thereto. According to other embodiments of the application, the antenna 320 can also be integrated into the wireless communication module 310, and both of them are packaged together with a system-in-package (SiP) formation process, transforming the wireless communication device 300 into a micro module.

Figure 2C:
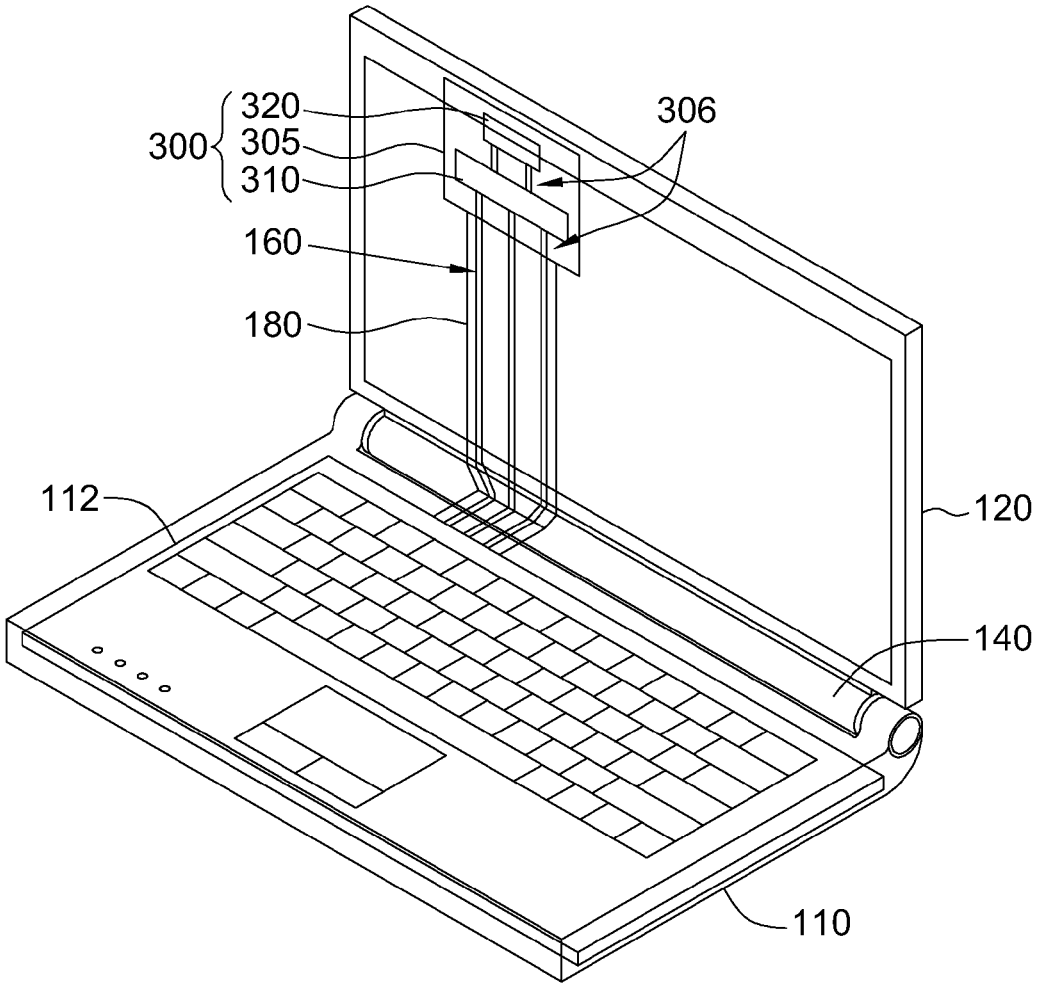

As in another practical example, the wireless communication module 310 and the antenna 320 can be disposed on a circuit board 305 which has patterned interconnection, which is shown in FIG. 2C. FIG. 2C is a schematic diagram showing another example of the connection between the wireless communication device 300 and the control unit 112 according to an embodiment of the application. In this example, the wireless communication device 300 further includes a circuit board 305 which has patterned interconnection, and the antenna 320 is disposed on the circuit board 305. The wireless communication module 310 is carried on the circuit board 305 and is electrically connected thereto, so as to be connected to the control unit 112 and the antenna 320 through the patterned interconnection 306 of the circuit board 305. The connection between the wireless communication module 310 and the control unit 112 can be achieved by, for example, connecting the wireless communication module 310 to the control unit 112 through the transmission line 160 to form signal connection.

For example, the wireless communication module 320 can include a circuit board, a number of electronic elements for performing wireless communication, and a cover layer disposed on the circuit board for covering and protecting the electronic elements. In some embodiments, the cover layer includes at least one via hole which exposes a part of the circuit board. The antenna is disposed on the surface of the cover layer of the wireless communication module, and is electrically connected to the circuit board through the at least one via hole. In another embodiment, the wireless communication device can further include a flexible circuit board on which the antenna 320 is disposed. A part of the flexible circuit board is embedded in the circuit board. The flexible circuit board is electrically connected to the circuit board of the wireless communication module at where it is embedded in the circuit board. Therefore, according to the wireless communication device 300 of each embodiment, the antenna 320 can be integrated into the wireless communication module 310.

A number of embodiments are provided below for further describing how the antenna 320 is integrated into the wireless communication module 310.

First Embodiment

Figure 3A:
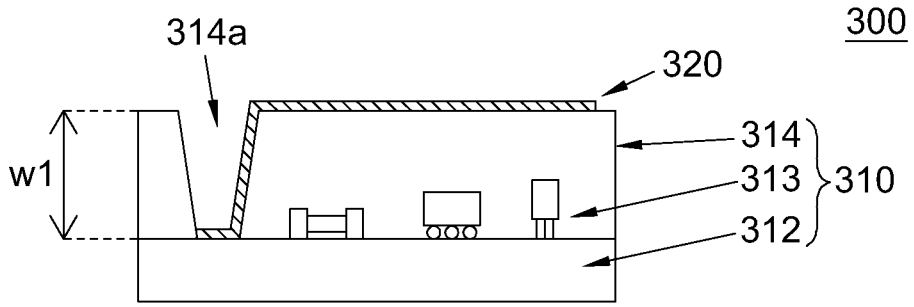
FIG. 3A is a cross-section view showing an example of the structure of the wireless communication device according to a first embodiment of the application.

FIG. 3A is a cross-section view showing an example of the structure of the wireless communication device 300 according to a first embodiment of the application.

In the first embodiment, the wireless communication module 310 can include a circuit board 312, a number of electronic elements 313, and a cover layer. The electronic elements 313 are disposed on the circuit board 312 for performing wireless communication, and the cover layer is disposed on the circuit board 312. The cover layer in the first embodiment is a molding material layer 314, as shown in FIG. 3A.

The molding material layer 314 covers the circuit board 312. The molding material layer 314 has, for example, a via hole 314*a*, which passes through the molding material layer 314 to expose a part of the circuit board 312. The antenna 320 is disposed on the molding material layer 314, and connected to the circuit board 312 through the via hole 314*a*.

For example, the antenna 320 in the first embodiment can be a planar antenna implemented by a metal layer. The metal layer has antenna patterns which correspond to the wireless communication module 310. The metal layer is disposed on the surface of the molding material layer 314 by way of metal deposition, such as the one capable of forming interconnection on plastic material mentioned above. The metal layer is electrically connected to the circuit board 312 through the at least one via hole 314*a*. It is obtained that the antenna 320 of the first embodiment directly formed on the molding material layer 314.

Therefore, according to the wireless communication device 300 of the embodiment, the antenna 320 can be integrated into the wireless communication module 310.

Second Embodiment

Figure 3B:
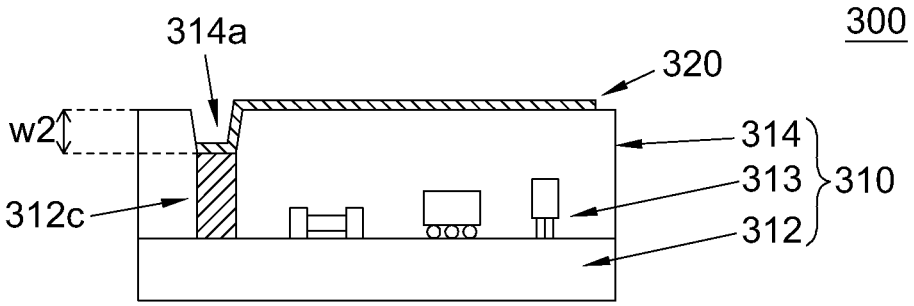
FIG. 3B is a cross-section view showing an example of the structure of the wireless communication device according to a second embodiment of the application.

FIG. 3B is a cross-section view showing an example of the structure of the wireless communication device 300 according to a second embodiment of the application.

Different from the first embodiment, the wireless communication module 310 of the second embodiment can further include at least one conductor element, such as one conductor element 312*c*. As shown in FIG. 3B, the conductor element 312*c* is protruded from the circuit board 312, and the via hole 314*a* exposes a part of the conductor element 312*c*. In practice, the conductor element is, for example, a metal stud or a metal bump.

Similar to the first embodiment, the antenna 320 can also be disposed on the molding material layer 314, and is electrically connected to the circuit board 312 through the via hole 314*a* and the conductor element 312*c*.

For example, the antenna 320 of the second embodiment can also be a planar antenna implemented by a metal layer. Moreover, as shown in FIG. 3B, the metal layer can also be disposed on the surface of the molding material layer 314 by way of metal deposition, and can be electrically connected to the conductor element 312*c* through the via hole 314*a*, so as to be electrically connected to the circuit board 312. It is obtained that the antenna 320 of the second embodiment is directly formed on the molding material layer 314.

Therefore, according to the wireless communication device 300 of the embodiment, the antenna 320 can be integrated into the wireless communication module 310.

Besides, as compared with the first embodiment, the second embodiment further has the following advantages. Refer to both of FIGS. 3A and 3B. For the via hole 314*a* in FIG. 3A, it is required to be penetrated with a depth w1, for example, 1000 micron-meter. As for the via hole 314*a* in FIG. 3B, it is required to be penetrated with a less depth w2, for example, 100 micron-meter since the conductor element 312*c* is protruded from circuit board 312. The required depth of via hole 314*a* in FIG. 3B is much less, which improves the accuracy in forming the via hole 314*a*, and reduces the process time for the second embodiment. Moreover, because the distance between the via hole 314*a* and the circuit board 312 is longer, this embodiment can further avoid damaging the circuit board 312 in the course of forming the via hole 314*a*.

Third Embodiment

Figure 4A:
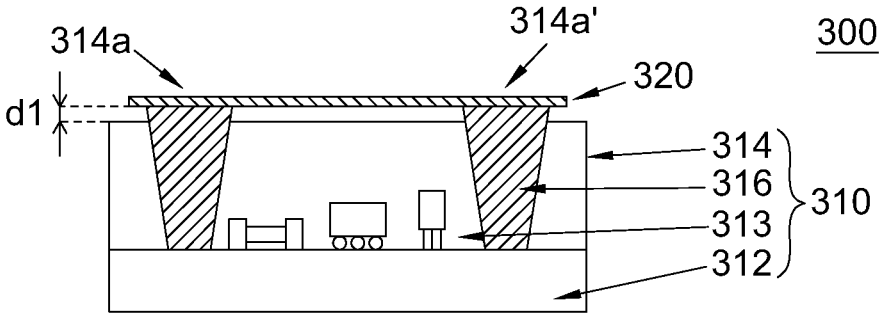
FIG. 4A is a cross-section view showing an example of the structure of the wireless communication device according to a third embodiment of the application.

FIG. 4A is a cross-section view showing an example of the structure of the wireless communication device 300 according to a third embodiment of the application.

The molding material layer 314 can have one or more via holes. For example, as shown in FIG. 4A, the molding material layer 314 has two via holes, which are used to enhance the strength of connection between the antenna 320 and the wireless communication module 310, or used to allow the wireless communication module 310 to be connected with two different antennas. However, this application is not limited thereto. The amount of via holes of the molding material layer 314 can be determined according to different requirements. For the sake of illustration, the molding material layer 314 in the third embodiment is exemplified as having two via holes 314*a* and 314*a'*.

Referring to FIG. 4A, the molding material layer 314 in the third embodiment have, for example but non-limitedly, two via holes 314*a* and 314*a*', which pass through the molding material layer 314 and expose a part of the circuit board 312. As shown in FIG. 4A, the antenna 320 is disposed on the molding material layer 314, and is electrically connected to the circuit board 312 through the two via holes 314*a* and 314*a'*.

Different from the first embodiment, the wireless communication module 310 in the third embodiment further includes a conductor material layer 316, which is disposed on the inside of the two via holes 314*a* and 314*a*' of the molding material layer 314. The conductor material layer 316 contacts with the circuit board 312 exposed by the two via hole 314*a* and 314*a*', and extends out of the two via holes 314*a* and 314*a*'. In the third embodiment, the antenna 320 can be a planar antenna implemented by a metal plate. The metal plate has antenna patterns which correspond to the wireless communication module 310. Moreover, as shown in FIG. 4A, the metal plate and the conductor material layer 316 which extends out of the two via holes 314*a* and 314*a*' are contacted with each other by welding, so that the metal plate can be electrically connected to the circuit board. It is obtained that the antenna 320 of the third embodiment and the molding material layer 314 are separated by an interval d1, in which an air layer or an adhesive material layer can be filled.

Therefore, according to the wireless communication device 300 of the embodiment, the antenna 320 can be integrated into the wireless communication module 310.

Fourth Embodiment

Figure 4B:
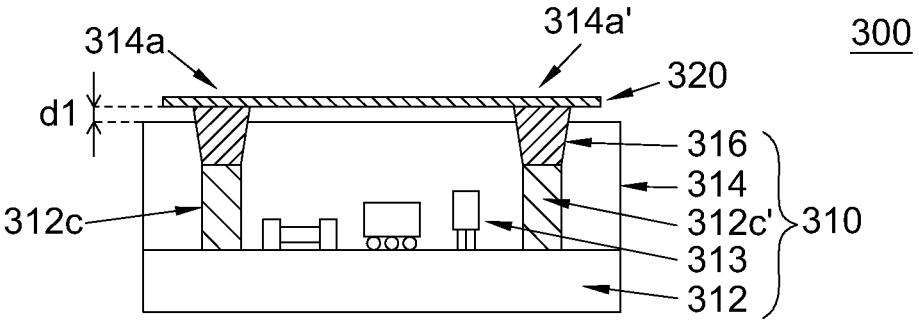
FIG. 4B is a cross-section view showing an example of the structure of the wireless communication device according to a fourth embodiment of the application.

FIG. 4B is a cross-section view showing an example of the structure of the wireless communication device 300 according to a fourth embodiment of the application.

Different form the third embodiment, the wireless communication module 310 in the fourth embodiment further include at least one conductor element, such as two conductor elements 312*c* and 312*c*'. As shown in FIG. 4B, the two conductor elements 312*c* and 312*c*' are extended from the circuit board 312, and the two via holes 314*a* and 314*a*' expose a part of the two conductor elements 312*c* and 312*c*'. In practice, each conductor elements 312*c* and 312*c*' can be, for example, a metal stud or a metal bump.

Similar to the third embodiment, the antenna 320 is also disposed on the molding material layer 314, and is electrically connected to the circuit board 312 through the two via holes 314*a* and 314*a'*.

For example, the antenna 320 in the fourth embodiment is a planar antenna implemented by a metal plate. As shown in FIG. 4B, the metal plate and the conductor material layer 316 which extends out of the two via holes 314*a* and 314*a*' are contacted with each other by welding, so that the metal plate can be electrically connected to the circuit board 312 through the two conductor elements 312*c* and 312*c*'. It is obtained that the antenna 320 in the third embodiment and the molding material layer 314 are separated by an interval d1, in which an air layer or an adhesive material layer can be filled.

Therefore, according to the wireless communication device 300 of the embodiment, the antenna 320 can be integrated into the wireless communication module 310.

Fifth Embodiment

Figure 5A:
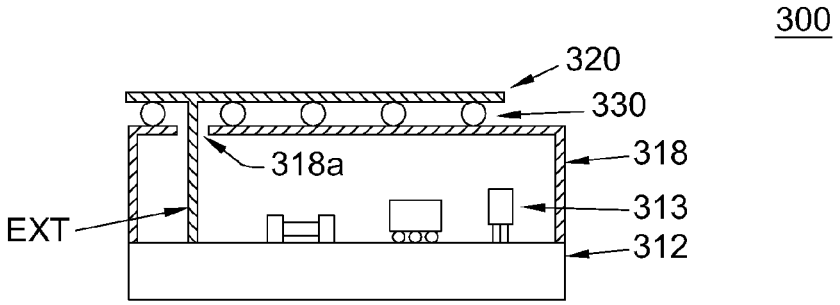
FIG. 5A is a cross-section view showing an example of the structure of the wireless communication device according to a fifth embodiment of the application.

FIG. 5A is a cross-section view showing an example of the structure of the wireless communication device 300 according to a fifth embodiment of the application.

Different from the first embodiment, the cover in the fifth embodiment is a metal lid 318. In practice, the metal lid 318 can have a number of holes (no shown) or does not have any holes. The metal lid 318 covers the circuit board 312. The metal lid 318 has a via hole 318*a* which passes through the metal lid 318 and expose a part of the circuit board 312. The antenna 320 is disposed on the metal lid 318, and is electrically connected to the circuit board 312 through the via hole 318*a*.

For example, the wireless communication device 300 includes, for example, an insulation layer 330, which is sandwiched between the antenna 320 and the metal lid 318. In practice, the insulation layer 330 can be implemented by insulation adhesive agent, and the antenna 320 can be attached to the metal lid 318 through the insulation adhesive agent. Preferably, the insulation adhesive agent is disposed in a mesh-like structure so as to form spaces between the metal lid 318 and the antenna 320, as shown in FIG. 5A. The spaces therebetween are filled with the air. Due to the relatively low dielectric constant of the air such as the value of K is about 1, the insulation layer 330 will have the characteristic of low dielectric constant, i.e., low-K.

The antenna 320 in the fifth embodiment can be a planar antenna implemented by a metal plate. The metal plate has antenna patterns which correspond to the wireless communication module 310. Moreover, as shown in FIG. 5A, the metal plate further has a protruded portion EXT, and the metal plate is electrically connected to the circuit board 312 with its protruded portion EXT through the via hole 318*a*.

As compared with the first to the fifth embodiments, this embodiment further has the following advantages. As shown in FIG. 5A, when the metal lid 318 in the embodiment is covered on the circuit board 312, it functions as an electromagnetic interference shielding, which prevents the electronic elements 313 of the circuit board 312 from being interfered by external electromagnetic waves, or prevents the electronic elements 313 of the circuit board 312 form generating electromagnetic waves and interfering other external circuits. Hence, the wireless communication device 300 in the embodiment can provide better shielding against electromagnetic interference.

Therefore, according to the wireless communication device 300 of the embodiment, the antenna 320 can be integrated into the wireless communication module 310.

Sixth Embodiment

Figure 5B:
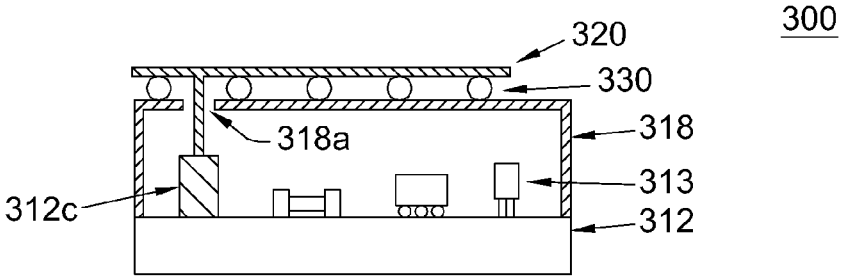
FIG. 5B is a cross-section view showing an example of the structure of the wireless communication device according to a sixth embodiment of the application.

FIG. 5B is a cross-section view showing an example of the structure of the wireless communication device 300 according to a sixth embodiment of the application.

Different from the fifth embodiment, the wireless communication module 310 in the sixth embodiment further includes at least one conductor element, such as a conductor element 312*c*. As shown in FIG. 5B, the conductor element 312*c* is protruded from the circuit board 312, and a part of which is exposed by the via hole 312*c*. In practice, the conductor element 312*c* is, for example, a metal stud or a metal bump.

Similar to the fifth embodiment, the antenna 320 can also be disposed on the metal lid 318, and is electrically connected to the circuit board 312 through the via hole 318*a*.

For example, as shown in FIG. 5B, the antenna 320 in the sixth embodiment can be a planar antenna implemented by a metal plate. The metal plate is electrically connected to the conductor element 312*c* with its protruded portion EXT through the via hole 318*a*, so as to be electrically connected to the circuit board 312.

Therefore, according to the wireless communication device 300 of the embodiment, the antenna 320 can be integrated into the wireless communication module 310.

Seventh Embodiment

Figure 6A:
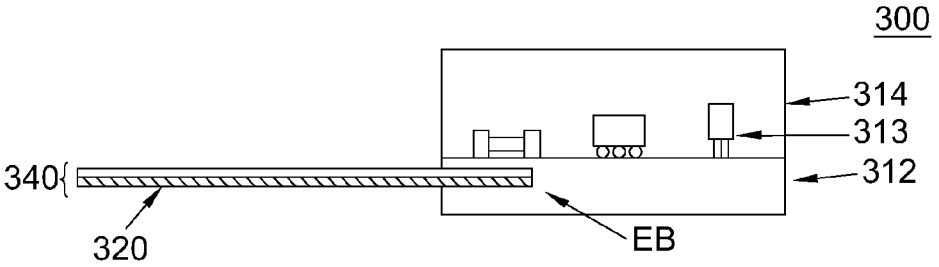
FIG. 6A is a cross-section view showing an example of the structure of the wireless communication device according to a seventh embodiment of the application.

FIG. 6A is a cross-section view showing an example of the structure of the wireless communication device 300 according to a seventh embodiment of the application.

The seventh embodiment differs from the first embodiment in that the wireless communication device 300 in the seventh embodiment further includes a flexible circuit board 340. As shown in FIG. 6A, the antenna 320 is disposed on the flexible circuit board 340. A part of the flexible circuit board 340 is embedded in the circuit board 312, as illustrated by the arrow EB. The flexible circuit board 340 is electrically connected to the circuit board 312 of the wireless communication module 310 at where it is embedded therein.

Figure 6B:
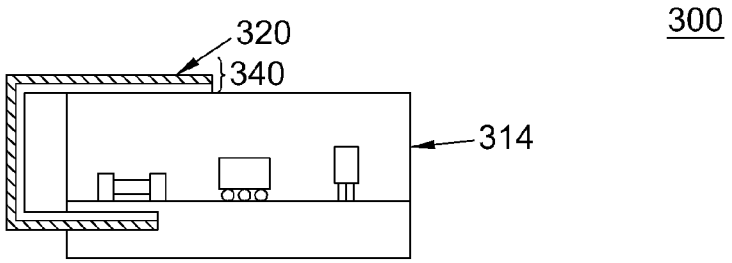
FIG. 6B is a cross-section view showing an example of the structure of the wireless communication device in FIG. 6A when the antenna is fixed on the surface of the wireless communication device.

Moreover, FIG. 6B is a cross-section view showing an example of the structure of the wireless communication device 300 in FIG. 6A when the antenna 320 is fixed on the surface of the wireless communication device 300. In this example, as shown in FIG. 6B, the rest part of the flexible circuit board 340 which is not embedded in the circuit board 312 is fixed on the molding material layer 314, so that the flexible circuit board 340 exhibits a folded form. A grounding plane (not shown) can be, for example, disposed on the flexible circuit board 340, corresponding to which the folded antenna 312 can generate radiation. Moreover, the grounding plane can also provide better shielding against electromagnetic interference for the wireless communication device 300.

Besides, as shown in FIGS. 6A and 6B, the cover layer in the embodiment is taken as the molding material layer 314 for illustration. However, this application is not limited thereto. The cover layer in the embodiment can also be implemented by the mentioned metal lid 318, whose function and structure are similar to that of the fourth and the fifth embodiments while detailed description is not repeated.

Therefore, according to the wireless communication device 300 of the embodiment, the antenna 320 can be integrated into the wireless communication module 310.

In practice, when using the wireless communication module, a user usually needs to design the antenna according to the characteristic of the wireless communication module. According to the disclosed embodiments of the application, integrating the antenna into the wireless communication module prevents the user from having to design the antenna correspondingly, thereby increasing the user's convenience.

Figure 2D:
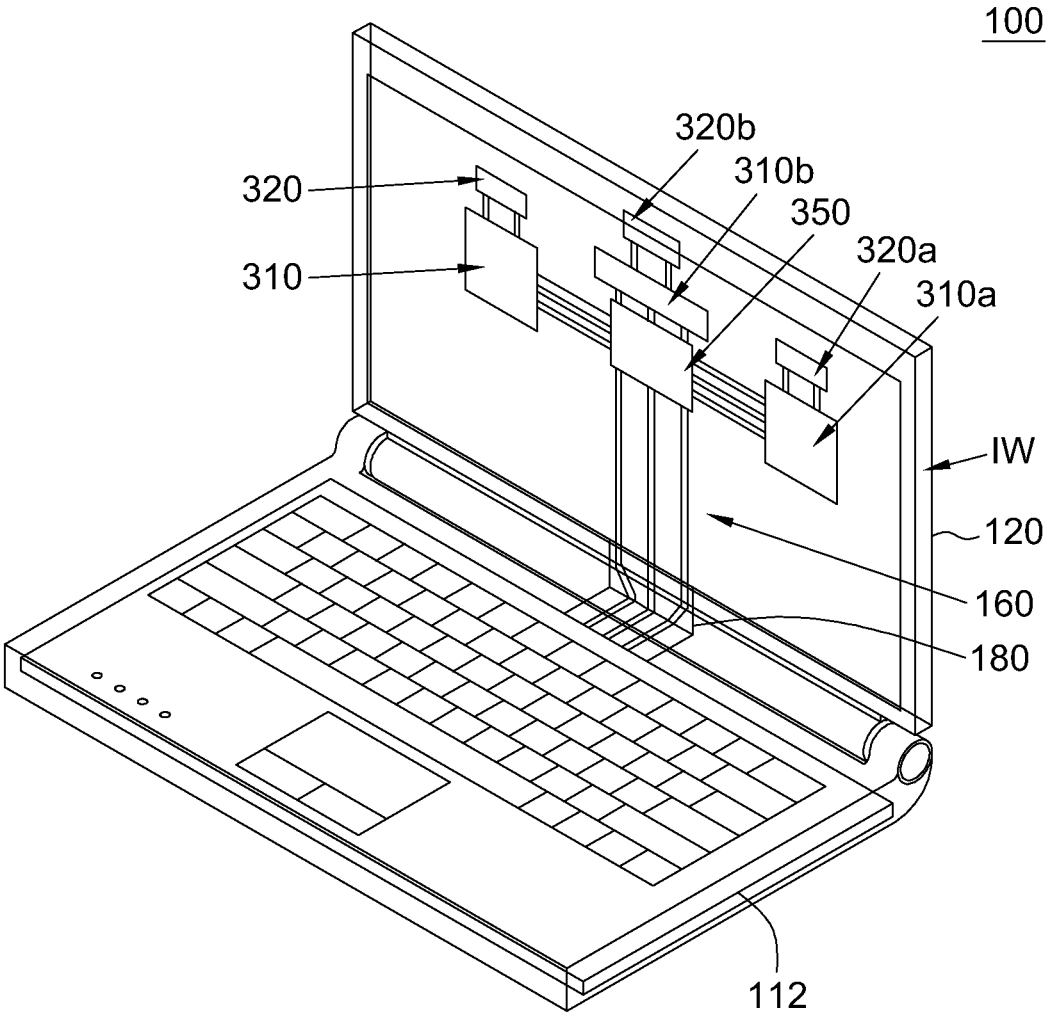

Besides, in FIG. 2D, the portable electronic apparatus 100 can further include a switch 350. The switch 350 can be implemented by a hub. The switch 350 connects one of the wireless communication modules 310, 310*a*, and 310*b* to the control unit 112, and is for enabling a corresponding one of the wireless communication modules 310, 310*a*, and 310*b* under control of the control unit 112. The enabled wireless communication module can thus perform wireless communication through a corresponding antenna. In this way, the portable electronic apparatus 100 can provide communication services supported with several communication protocols, so as to meet the user's requirement.

According to the present embodiments of the application, the wireless communication device and the portable electronic apparatus using the same can reduce the decay of antenna signals, enhance the sensitivity of wireless communication module, reduce the power dissipation, and improve the system performance. As in another embodiment, the provided wireless communication device can also be reduced for its occupied space on a main board, thus saving the required space.

While the application has been described by way of example and in terms of a preferred embodiment, it is to be understood that the application is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A portable electronic apparatus, comprising:

a first housing and a second housing rotatably coupled to each other;

a control unit accommodated in the first housing;

a display unit accommodated in the second housing and connected to the control unit; and a wireless communication device accommodated in the second housing, the wireless communication device including:

an antenna;

a wireless communication module connected to the control unit and the antenna for performing wireless communication through the antenna under control of the control unit; and a circuit board with patterned interconnection, on which the antenna is disposed, the wireless communication module being carried on the circuit board to establish electrical connection, and being connected to the control unit and the antenna through the patterned interconnection of the circuit board.

2. The portable electronic apparatus according to claim 1, wherein the wireless communication module comprises:

a plurality of electronic elements disposed on the circuit board for performing wireless communication; and a cover layer disposed on the circuit board, the cover layer having at least one via hole which exposes a part of the circuit board;

wherein the antenna is disposed on a surface of the cover layer of the wireless communication module, and is electrically connected to the circuit board through the at least one via hole.

3. The portable electronic apparatus according to claim 2, wherein the cover layer is a molding material layer which covers the circuit board, and the at least one via hole passes through the molding material layer to expose a part of the circuit board.

4. The portable electronic apparatus according to claim 3, wherein the antenna is a planar antenna comprising metal, the metal layer being disposed on the surface of the molding material layer by way of metal deposition, and the planar antenna being electrically connected to the circuit board through the at least one via hole.

5. The portable electronic apparatus according to claim 3, wherein the wireless communication module further comprises:

a conductor element protruded from the circuit board, a part of which is exposed by the at east one via hole;

wherein the antenna is a planar antenna comprising metal, the planar antenna being disposed on the surface of the molding material layer by way of metal deposition, and the planar antenna being electrically connected to the conductor element through the at least one via hole, so as to be electrically connected to the circuit board.

6. The portable electronic apparatus according to claim 3, wherein the wireless communication module further comprises:

a conductor material layer, disposed on the inside of the at least one via hole of the molding material layer, contacting with the circuit board exposed by the at least one via hole, and extending out of the at least one via hole;

wherein the antenna is a planar antenna comprising metal, and the planar antenna being electrically connected to the conductor material layer which extends out of the at least one via hole, so as to be electrically connected to the circuit board.

7. The portable electronic apparatus according to claim 3, wherein the wireless communication module further comprises:

at least one conductor element protruded from the circuit board, a part of which is exposed by the at least one via hole; and a conductor material layer, disposed on the inside of the at least one via hole of the molding material layer, contacting with the at least one conductor element exposed by the at least one via hole, and extending out of the at least one via hole;

wherein the antenna is a planar antenna comprising metal, and the planar antenna being electrically connected to the conductor material layer which extends out of the at least one via hole, so as to be electrically connected to the circuit board through the at least one conductor element.

8. The portable electronic apparatus according to claim 2, wherein the cover layer is a metal lid, the metal lid covers the circuit board, and the at least one via hole passes through the metal lid to expose a part of the circuit board;

wherein the antenna is a planar antenna implemented by a metal plate, the metal plate has antenna patterns which correspond to the wireless communication module, the metal plate further has a protruded portion, and the metal plate is electrically connected to the circuit board with its protruded portion through the at least one via hole.

9. The portable electronic apparatus according to claim 8, wherein the wireless communication device further comprises:

an insulation layer sandwiched between the antenna and the metal lid, the insulation layer being implemented by insulation adhesive agent, and the antenna being attached to the metal lid through the insulation adhesive agent;

wherein the insulation adhesive agent is disposed in a mesh-like structure.

10. The portable electronic apparatus according to claim 9, wherein the wireless communication module further comprises:

at least one conductor element protruded from the circuit board, a part of which being exposed by the at least one via hole;

wherein the antenna is a planar antenna implemented by a metal plate, the metal plate has antenna patterns which correspond to the wireless communication module, the metal plate further has a protruded portion, and the metal plate is electrically connected to the at least one conductor element with its protruded portion through the at least one via hole, so as to be electrically connected to the circuit board.

* * * * *